US010126037B2

(12) United States Patent
Barrena et al.

(10) Patent No.: US 10,126,037 B2
(45) Date of Patent: Nov. 13, 2018

(54) ICE-MAKER MOTOR WITH INTEGRATED ENCODER AND HEADER

(71) Applicant: ILLINOIS TOOL WORKS INC., Glenview, IL (US)

(72) Inventors: Juan J. Barrena, Johnston, RI (US); James M. Maloof, Westwood, MA (US); Eric K. Larson, Cumberland, RI (US); Jeffrey L. Prunty, Wrentham, MA (US)

(73) Assignee: Illinois Tool Works Inc., Glenview, IL (US)

( * ) Notice: Subject to any disclaimer, the term of this patent is extended or adjusted under 35 U.S.C. 154(b) by 278 days.

(21) Appl. No.: 14/438,231

(22) PCT Filed: Oct. 22, 2013

(86) PCT No.: PCT/US2013/066045

§ 371 (c)(1),
(2) Date: Apr. 24, 2015

(87) PCT Pub. No.: WO2014/070512

PCT Pub. Date: May 8, 2014

(65) Prior Publication Data

US 2015/0276295 A1 Oct. 1, 2015

Related U.S. Application Data

(60) Provisional application No. 61/722,414, filed on Nov. 5, 2012, provisional application No. 61/804,018, filed on Mar. 21, 2013.

(51) Int. Cl.

| | |
|---|---|
| ***F25C 5/187*** | (2018.01) |
| ***F25C 1/04*** | (2018.01) |
| ***F25C 1/00*** | (2006.01) |

(52) U.S. Cl.
CPC ..... *F25C 5/187* (2013.01); *F25C 1/00* (2013.01); *F25C 1/04* (2013.01);
(Continued)

(58) Field of Classification Search
CPC ..... F25C 5/187; F25C 2700/02; F25C 1/10; F25C 1/20; F25C 5/06; F25C 2700/06;
(Continued)

(56) References Cited

U.S. PATENT DOCUMENTS 2,463,349 A * 3/1949 Baner ..... F16H 1/22 310/112
3,871,242 A * 3/1975 Linstromberg ..... F16D 11/00 74/421 A (Continued)

FOREIGN PATENT DOCUMENTS

EP 2151644 A1 2/2010
JP 2001041620 A 2/2001

(Continued)

OTHER PUBLICATIONS

Application Note DK92220410-0014, Motion Control, Beckhoff, Apr. 2010.*

(Continued)

*Primary Examiner* — Orlando E Aviles Bosques
*Assistant Examiner* — Schyler S Sanks
(74) *Attorney, Agent, or Firm* — Boyle Fredrickson, S.C.

(57) ABSTRACT

An ice maker mechanism provides a position sensor sensing the position of the ice tray to allow control of absolute position of the ice tray without the need for motor stalling such as generates heat and wastes energy. An ice maker mechanism provides two motors for rotating the ice tray adapted for high torques low-speed rotation and low torque high-speed rotation the latter used for agitation of the water during freezing.

24 Claims, 9 Drawing Sheets

(52) U.S. Cl.
CPC .... *F25C 2305/022* (2013.01); *F25C 2600/04* (2013.01); *F25C 2700/12* (2013.01)

(58) Field of Classification Search
CPC ..... F25C 2305/022; F25C 1/18; F25C 5/20; F25C 5/22
USPC ..... 62/135, 136, 137
See application file for complete search history.

(56) References Cited

U.S. PATENT DOCUMENTS 4,628,698 A * 12/1986 Needham ..... F25C 1/04 62/137
6,058,720 A 5/2000 Ryu
6,148,620 A * 11/2000 Kumagai ..... F25C 1/04 62/135
2004/0194480 A1* 10/2004 Kim ..... F25C 1/04 62/135
2006/0090485 A1* 5/2006 Lee ..... F25C 1/04 62/135
2010/0097024 A1* 4/2010 Liu ..... H02P 29/027 318/434
2010/0139295 A1* 6/2010 Zuccolo ..... F25C 1/10 62/68
2010/0242548 A1* 9/2010 Webster ..... D06F 39/005 68/139
2014/0165604 A1* 6/2014 Boarman ..... F25B 21/02 62/3.3

FOREIGN PATENT DOCUMENTS

JP 2004116994 A 4/2004
JP 3574011 B2 * 10/2004
JP 2006078083 A 3/2006

OTHER PUBLICATIONS

Motion Control Made Easy!, Anaheim Automation, Oct. 21, 2011.*
English Translation of JP3574011B2.*
ISR and WO dated Feb. 14, 2014 for PCT/US2013/066045.

* cited by examiner

FIG. 13
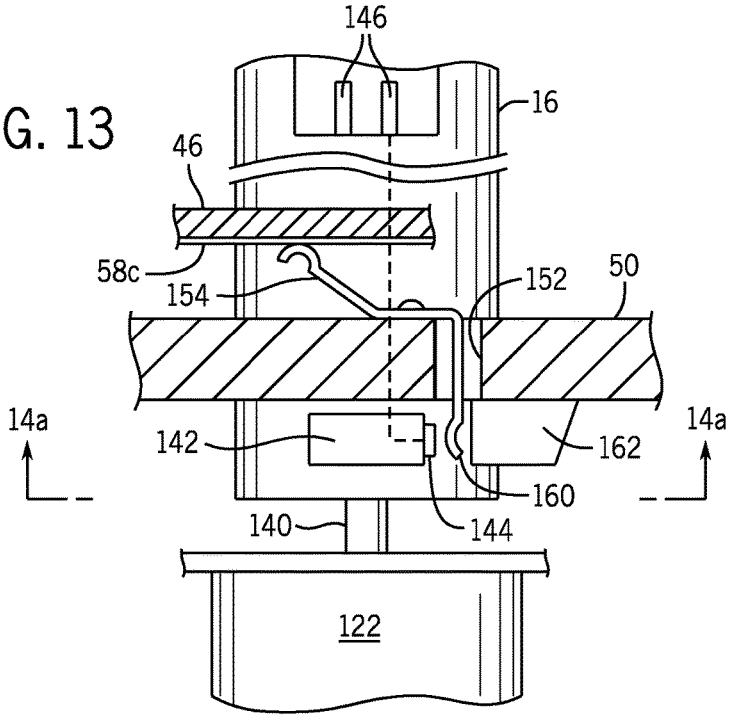
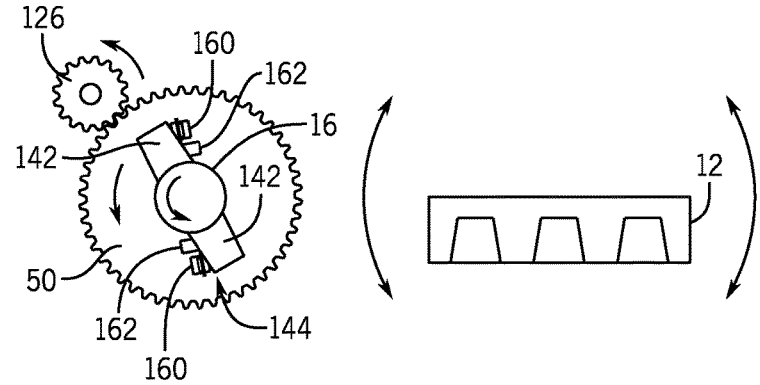
FIG. 14a
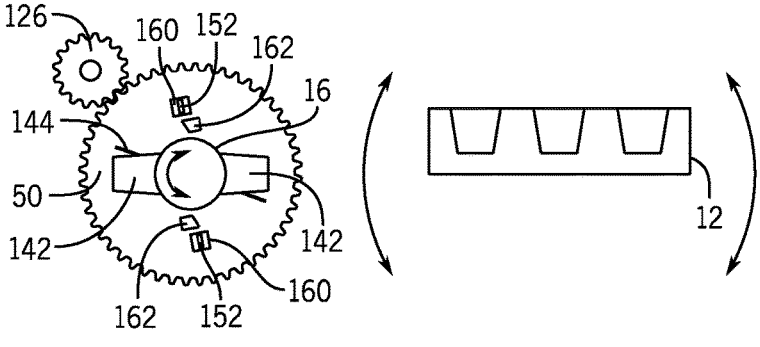
FIG. 14b

ICE-MAKER MOTOR WITH INTEGRATED ENCODER AND HEADER

CROSS-REFERENCE TO RELATED APPLICATIONS

This application claims the benefit of U.S. provisional applications 61/804,018 filed Mar. 21, 2013 and 61/722,414 filed Nov. 5, 2012 both hereby incorporated in their entirety by reference.

FIELD OF THE INVENTION

The present invention relates to ice making machines for home refrigerators and the like and specifically to an ice-making machine providing multiposition feedback with respect to an ice-maker motor position.

BACKGROUND OF THE INVENTION

Household refrigerators commonly include automatic ice-makers located in the freezer compartment. A typical ice-maker provides an ice cube mold positioned to receive water from an electric valve that may open for a predetermined time to fill the mold. The water is allowed to cool until a temperature sensor attached to the mold detects a predetermined low-temperature point where ice formation is ensured. At this point, the ice is harvested from the mold by a drive mechanism into an ice bin positioned beneath the ice mold.

The ice harvesting mechanism may, in one example, distort the ice mold to remove the "cubes" by twisting one end of the flexible ice tray when the other end abuts a stop. After a brief period of time during which the motor twisting the ice mold may stall and during which the ice cubes may be ejected from the tray, the motor is reversed in direction to bring the ice tray back to its fill position for refilling. Alternatively, the cubes may be ejected by rotating an ejector comb that sweeps through the tray to remove the cubes. At the end of the ejection cycle, the tray or comb returns to a home position as may be detected by a limit switch.

An ice sensor may be provided to determine when the ice-receiving bin is full. One sensor design periodically lowers a bail arm into the ice bin after each harvesting to gauge the amount of ice in the bin. If the bail arm's descent, as determined by a limit switch, is limited by ice filling the bin to a predetermined height, harvesting is suspended.

SUMMARY OF THE INVENTION

Allowing the motor to stall unnecessarily consumes electrical energy. Detecting multiple positions of the motor during operation, however, requires either multiple electrical switches or other sensors which can be relatively expensive.

The present invention provides a motor for an ice-maker mechanism that includes an integrated encoder detecting motor position allowing a number of different motor positions to be detected at relatively low incremental cost. By detecting the motor positions, motor current may be stopped during periods when otherwise the motor would stall. The encoder may be realized by a printed circuit board that also implements a switch for the ice bail arm and which supports an integrated connector providing all power and signals to and from the ice-maker system.

Specifically, the present invention provides an ice making apparatus having a housing with a front wall adapted to be positioned adjacent to an ice mold for molding ice cubes. A rotatable shaft is provided through the front wall and a position sensor communicates with the rotatable shaft to provide an electrical position signal indicating a position of the rotatable shaft. Electrical conductors attach to the position sensor to communicate the electrical position signal to an electrical controller for controlling ice making.

It is thus a feature of at least one embodiment of the invention to provide absolute positioning of the ice tray or comb without the need for multiple discrete switches or motor stalling.

The ice making apparatus may include an electrical motor communicating with the rotatable shaft to receive electrical signals from the electrical connector and the controller may control the electrical motor according to electrical position signal.

It is thus a feature of at least one embodiment of the invention to permit sophisticated remote control of the ice making mechanism for example by a microprocessor positioned elsewhere in the refrigerator.

The electrical position signal may encode a position of the rotatable shaft in a magnitude of voltage or current.

It is thus a feature of at least one embodiment of the invention to provide a reduced wiring harness that can communicate position signals to a remote control device. By encoding position into a voltage a single wire pair may replace multiple wire pairs that might be required for separate switches.

The position sensor may provide a set of electrically switched connections communicating with a resistor ladder to provide a position signal in the form of a voltage dependent on a state of the electrically switched connections as they change with rotation of the position sensor.

It is thus a feature of at least one embodiment of the invention to provide a simple method of encoding switch positions into a voltage.

The position sensor may include a printed circuit board positioned to extend perpendicularly to the rotatable shaft near the rotatable shaft and providing traces having arcuate surfaces concentric about an axis of rotation of the rotatable shaft selectively interconnected by a wiper rotating with the rotatable shaft to implement the set of electrically switched connections.

It is thus a feature of at least one embodiment of the invention to provide a low-cost position encoder in the form of a multi-pole switch.

The encoder may include a magnet element attached for rotation with the rotatable shaft, the magnet element providing circumferentially periodic magnetic polarity zones and further including a Hall effect sensor positioned adjacent to the magnetic element to provide electrically switched connections that vary with rotation of the magnet element to provide an electrical position signal.

It is thus a feature of at least one embodiment of the invention to provide an encoder that may provide high resolution position information with the relatively simple mechanism.

The encoder may include a magnet element attached for rotation with the rotatable shaft, and further including multiple angularly displaced Hall effect sensors positioned along a path of the magnetic element with rotation of the rotatable shaft to provide electrically switched connections that vary with rotation of the magnet element to provide an electrical position signal.

It is thus a feature of at least one embodiment of the invention to provide an encoder using low-cost but robust solid-state switching elements.

The electrical conductors may provide a releasable electrical connector including electrical connector pins attached to a printed circuit board in the housing to extend through the housing to provide electrical communication to the printed circuit board and the housing may provide an integrated connector shell for surrounding the electrical connector pins to guide and retain a corresponding mating connector.

It is thus a feature of at least one embodiment of the invention to provide a cost reduced icemaker eliminate the need for a separate molded connector.

The housing may have interfitting front and back portions each supporting part of the connector shell and together providing a shroud surrounding the connector pins.

It is thus a feature of at least one embodiment of the invention to integrate the connector shell into the housing in a manner that provides simplified molding. By splitting the connector shell between housing halves an additional mold core may be eliminated.

The housing may further include right and left sidewalls flanking the front wall and may hold a second rotatable shaft extending from at least one of the right and left side walls at an end. Eight reciprocating mechanism may communicate with the first rotational shaft to provide reciprocation of the second rotatable shaft with rotation of the first rotatable shaft and a bail arm may be attached to the end. A second position sensor may communicate with the second rotatable shaft to sense a position of the bail arm.

It is thus a feature of at least one embodiment of the invention to provide remote sensing of the bail arm for sophisticated control of the ice making machine by a central controller.

The second position sensor may be electrical switch having contacts formed on the printed circuit board contacting contacts movable with the second rotatable shaft.

It is thus a feature of at least one embodiment of the invention to implement bail arm position sensing in a way that makes efficient use of a printed circuit board that may also be used with the first position sensor.

Alternatively, the second position sensor may be a magnet sensor activated by a magnet on the second rotatable shaft.

It is thus a feature of at least one embodiment of the invention to extend magnetic sensing usable in sensing the position of the first rotating shaft to sensing position of the bail arm.

The present invention further provides an ice making mechanism that may be adapted to operate in two modes: (1) to move the ice tray through a relatively large angle as part of the cycle of filling and ejecting the ice tray and (2) to move the ice tray through a relatively small angle to agitate water during freezing, for example, to promote reduced ice cloudiness or the like.

Specifically, in this embodiment, the invention provides an ice making apparatus having a housing with a front wall adapted to be positioned adjacent to an ice mold for molding ice cubes and a rotatable shaft exposed through the front wall. A brushless motor communicates with the rotatable shaft to rotate the rotatable shaft in a first mode of operation for agitating freezing water and a brush motor communicates with the rotatable shaft to rotate the rotatable shaft in a second mode of operation for releasing ice.

It is thus a feature of at least one embodiment of the invention to provide a dual mode of operation with increased operating life. By separating the task of low-frequency high torque ice ejection and high-frequency low torque agitation, a low torque brushless motor with improved wear characteristics may be used for the agitation task.

The brushless motor may be a stepper motor.

It is thus a feature of at least one embodiment of the invention to employ a brushless motor with high torque low-speed characteristics. It is a feature of at least one embodiment of the invention to employ a motor well adapted for open loop control to eliminate the need for high resolution position sensing.

The ice making apparatus may include a power transmitting element engaging the brushless motor over a first range of rotation of the first shaft and engaging the brush motor over a second range of rotation of the first shaft different from the first range.

It is thus a feature of at least one embodiment of the invention to reduce unnecessary wear on the non-operative motor. It is a feature of at least one embodiment of the invention to permit torque increasing speed reduction gears on the brush motor which if not disconnected from the rotatable shaft would prevent movement of the rotatable shaft by a directly connected brushless motor.

The ranges may overlap.

It is thus a feature of at least one embodiment of the invention to ensure positive connection of the rotatable shaft to at least one motor at all times.

The power transmitting elements may provide a gear having teeth along only a portion of its periphery to selectively engage corresponding gears driven by the brush motor and brushless motor in the first range of rotation and second range of rotation.

It is thus a feature of at least one embodiment of the invention to provide a simple method for connecting and disconnecting the two motors over predetermined ranges.

The brush motor may provide a speed reduction gear train between the brush motor and the rotatable shaft.

It is thus a feature of at least one embodiment of the invention to permit the use of low-cost brush motors.

Alternatively, the power transmitting mechanism may be a stop surface attached to a rotatable drive element driven by the brush motor, the stop surface engaging a concentrically rotating arm attached to the rotatable shaft driven by the brushless motor, the stop surface also engaging the rotating arm when the arm passes beyond a predetermined angular position with respect to rotatable drive element so that the rotating arm may reciprocate within a predetermined angular range without engagement with the rotatable drive element.

It is thus a feature of at least one embodiment of the invention to provide a power transmitting mechanism that mediates between two motors while always allowing the brush motor to remain engaged, for example, in the event of failure of the brushless motor.

The ice making apparatus may include temperature sensor signal conductors attached to rotate with the rotatable shaft and adapted for communication with a temperature sensor in an ice tray attached to the rotatable shaft and further including a slip ring system attached between the rotatable drive element and circuitry fixed with respect to the housing. The apparatus may further include contacts for connecting the signal conductors on the rotatable shaft with a portion of the slip ring system on the rotatable drive element only when the rotating arm engages the rotatable drive element.

It is thus a feature of at least one embodiment of the invention to provide a slip ring system for communicating temperature information from the rotating ice tray that is not adversely affected by repeated high cycle agitation of the ice tray which might wear out the slip ring surfaces.

Other features and advantages of the invention will become apparent to those skilled in the art upon review of the following detailed description, claims and drawings in which like numerals are used to designate like features.

BRIEF DESCRIPTION OF THE DRAWINGS

FIG. 13 is a cross-sectional view along lines 13-13 of FIG. 12 showing contacts for communicating between the slip rings and the thermocouple during an interengagement of the stops of FIG. 12; and FIGS. 14*a* and 14*b* are figures showing operation of the power transmission system of FIG. 12 in providing decoupling of the brushless motor and the brush motor during an agitation cycle.

Figure 1:
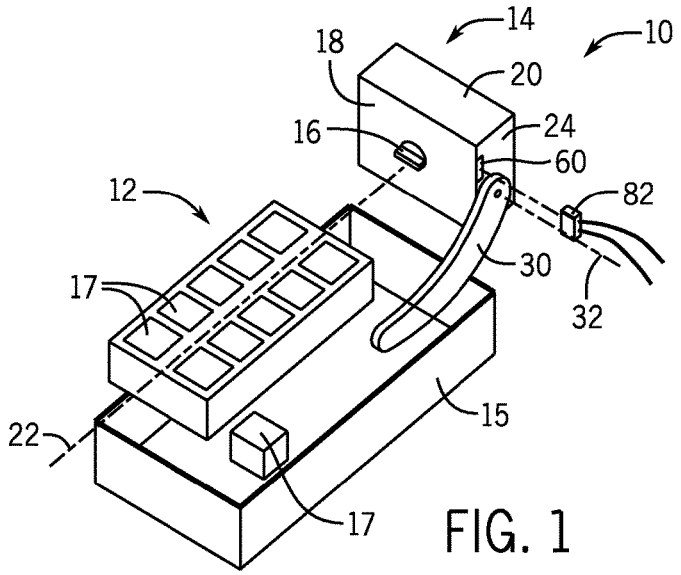
FIG. 1 is an exploded front elevational view of an ice-maker motor assembly which may rotate an ice tray for filling and harvesting of ice into an ice bin and showing a bail arm integrated to the ice-maker motor assembly for detecting ice height.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, an ice-maker 10 may include an ice mold 12 for receiving water and molding it into frozen ice cubes 17 of arbitrary shape. The ice mold 12 may be positioned adjacent to ice harvest drive mechanism 14 operating to remove cubes from the mold when they are frozen, for example, by inversion and distortion of the ice mold 12 or use of an ejector comb (not shown). The ice mold 12 may be positioned above an ice storage bin 15 for receiving cubes 17 therein when the latter are ejected from the ice mold 12.

The ice harvest drive mechanism 14 may have a drive coupling 16 exposed at a front wall 18 of a housing 20 of the ice harvest drive mechanism 14 and communicating with the mold 12 or comb. The drive coupling 16 may rotate about an axis 22 along which the ice mold 12 or comb extends.

The right wall 24 of the housing 20, flanking the front wall 18, may support one end of a bail arm 30 extending generally parallel to axis 22 allowing the bail arm 30 to pivot about a horizontal axis 32 generally perpendicular to axis 22 and extending from the right wall 24. As so attached, the opposed cantilevered end of the bail arm 30 may swing down into the ice storage bin 15 to contact an upper surface of the pile of cubes 17 in the ice storage bin 15 to determine the height of those cubes 17 and to deactivate the ice-maker 10 when a sufficient volume of cubes 17 is in the ice storage bin 15.

Encoder Using Mechanical Wiper

Figure 2:
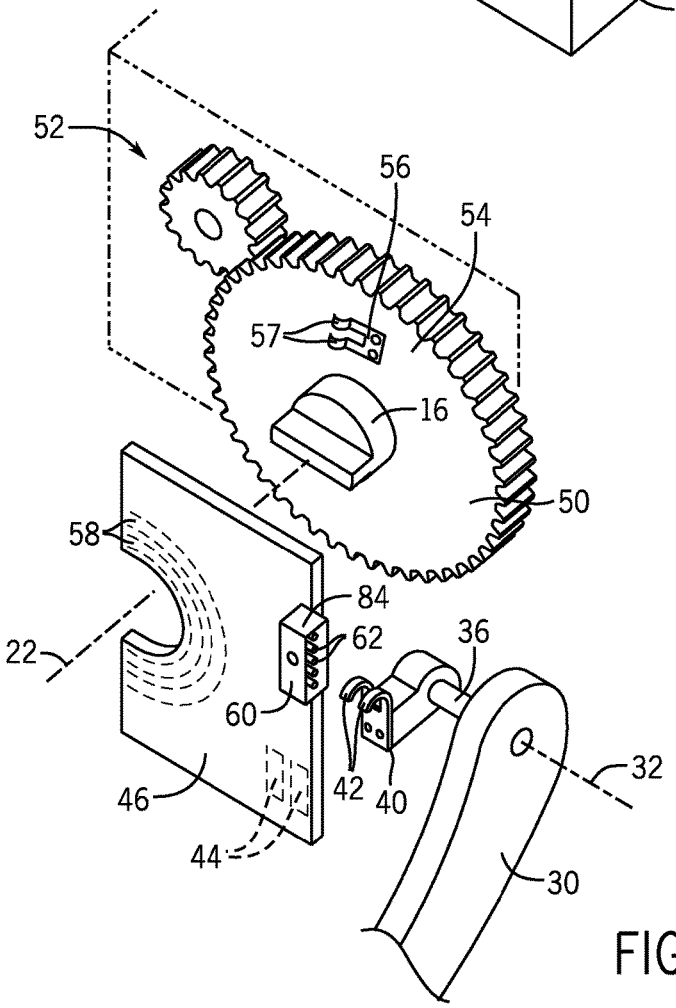
FIG. 2 is a front perspective view of a drive gear of the motor mechanism which communicates by a shaft to the ice mold and which supports a first wiper assembly on a front face of the drive gear that interacts with arcuate traces on a printed circuit board to provide an encoder-like indication of motor position and showing bail arm contact pads on that printed circuit board that may interact with a second wiper assembly on the bail arm for detecting bail arm position.

Referring now to FIGS. 1 and 2, the bail arm 30 may be a thermoplastic material and attached to a rotatable shaft 36 extending along axis 32 through the housing 20. Also attached to the shaft 36 within the housing 20 may be a first wiper assembly 40 having electrically joined flexible wiper fingers 42. The flexible wiper fingers may rotate with the shaft 36 to bridge across printed circuit contact pads 44 on a printed circuit board 46 positioned inside the housing 20 when the bail arm 30 is fully descended. With such contact, the printed circuit contact pads 44 are shorted together. When the bail arm 30 cannot fully descend as obstructed by a filling of the ice storage bin 15 with ice cubes 17, the flexible wiper fingers 42 are stopped away from the printed circuit contact pads 44 so that the printed circuit contact pads 44 are electrically separated.

Figure 4:
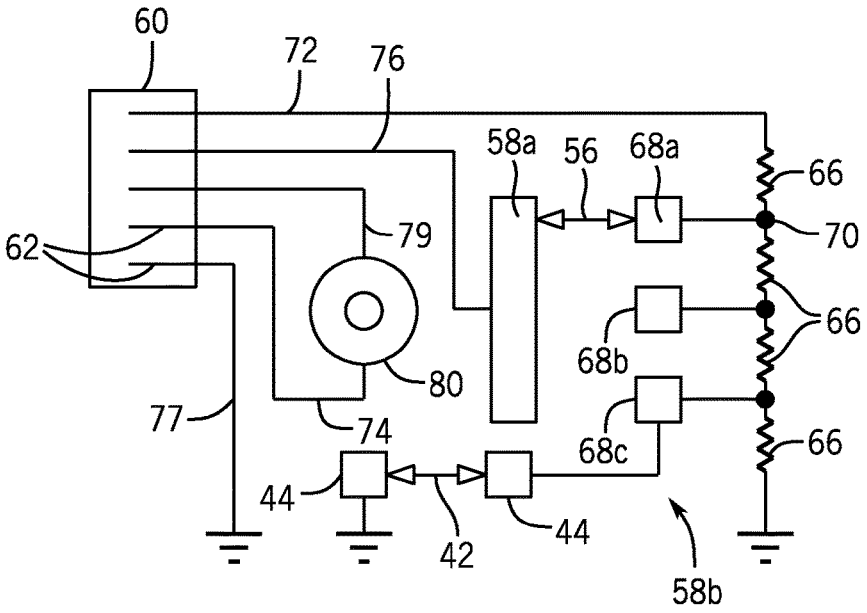
FIG. 4 is an electrical schematic of the circuit implemented by the printed circuit board and wiper assemblies of FIG. 2.

The drive coupling 16 may be a center hub of a drive gear 50 being part of a gear train 52 ultimately driven by a permanent magnet reversible DC motor (not shown in FIG. 2 but to be discussed with respect to FIG. 4). The gear train 52 provides an increase in torque and the reduction in rotation speed of the motor to turn the drive gear 50 at about two revolutions per minute. A front face 54 of the drive gear 50, generally normal to axis 22, supports a second wiper assembly 56 presenting electrically joined flexible wiper fingers 57 that may contact respective arcuate traces 58 on the printed circuit board 46 with rotation of the gear 50 about axis 22.

Generally a cam system (not shown) between the shaft 36 and other elements of the gear train 52 (for example a cam on a reverse face of the drive gear 50) may interact so that rotation of the drive gear 50 raises and drops the bail arm 30 appropriately during operation of the ice-maker 10.

Figure 3:
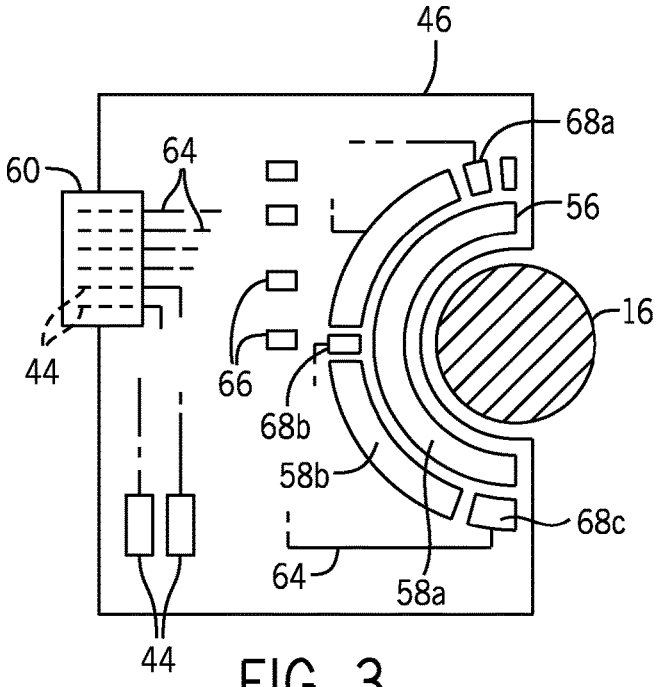
FIG. 3 is a rear elevational view of the printed circuit board of FIG. 2 showing the traces that interact with the first and second wiper assemblies of FIG. 2 and an integrated multi-pin connector.

Referring to FIGS. 2, 3, and 4, the printed circuit board 46 may support on an opposite face a five-pin electrical connector 60 that may be physically staked to the printed circuit board 46 and whose connector pins 62 may communicate, for example, by solder connections with printed circuit board traces 64 to various components on the circuit board 46 including resistors 66, the printed circuit contact pads 44, and the arcuate traces 58. The inner arcuate trace 58*a* may be generally continuous to provide for a conductor that may continuously connect with the second wiper assembly 56 throughout a range of positions of the drive coupling 16. In contrast, the outer arcuate trace 58*b* may be divided into different annular sectors 68*a*-68*c* (possibly separated by grounded sectors) that are electrically isolated from each other to provide for multiple throws of a rotary switch completed by the pole formed by the second wiper assembly 56 connecting through arcuate trace 58*a*. The sector 68*a* may be positioned directly above an axis of the drive coupling 16 at a 12 o'clock position, the sector 68*b* may be positioned to the side of an axis of the drive coupling 16 at a nine o'clock position (as viewed from the rear) and the sector 68*c* may be positioned directly below an axis of the drive coupling 16 at a six o'clock position as will be discussed further below.

Each of the separate sectors 68 of the outer arcuate trace 58*b* may communicate with a different node 70 of a resistor ladder 67, each node represented by connections between series connected resistors 66 forming the resistor ladder 67. The ends of the resistor ladder 67 may be connected between one pin 62 of connector 60 providing a positive DC voltage source 72 and one pin 62 providing a drive return 74. Accordingly, each of the nodes 70 will have a different voltage that may be communicated through the annular sectors 68 and the second wiper assembly 56 to the arcuate trace 58*a* and from there to one pin 62 of the connector 60 providing a position output line 76 whose voltage will be dependent on the rotation of the drive coupling 16 in the manner of an encoder.

One of the contact pads 44 may be connected to the ground 77 and the other contact pads 44 in sector 68*c* provide the lowest voltage tap on the resistor ladder of resistors 66 thereby providing an ice level signal by a pulling of output line 76 to ground. Finally, one pin 62 may be dedicated to providing a drive voltage 79 to the motor 80 driving the gear train with the other terminal of the motor 80 connected to the drive return 74 separate from ground 77 to allow a direction of drive of the motor 80 to be reversed by reversing the polarity of drive voltage 79 and drive return 74.

Referring to FIG. 1, connector 60 may be exposed at the right wall 24 of the ice harvest drive mechanism 14 to connect with a mating connector 82 for communicating with a control system 83 for the refrigerator. The control system 83 may be a microprocessor executing a stored program to control the ice-maker 10 as described herein as well as other refrigerator functions.

Example constructions of the gear train 52 and of other elements and components of the ice harvest drive mechanism 14 are described in US patent application 2012/0186288 hereby incorporated in its entirety by reference.

Integrated Connector Shell

Figure 5:
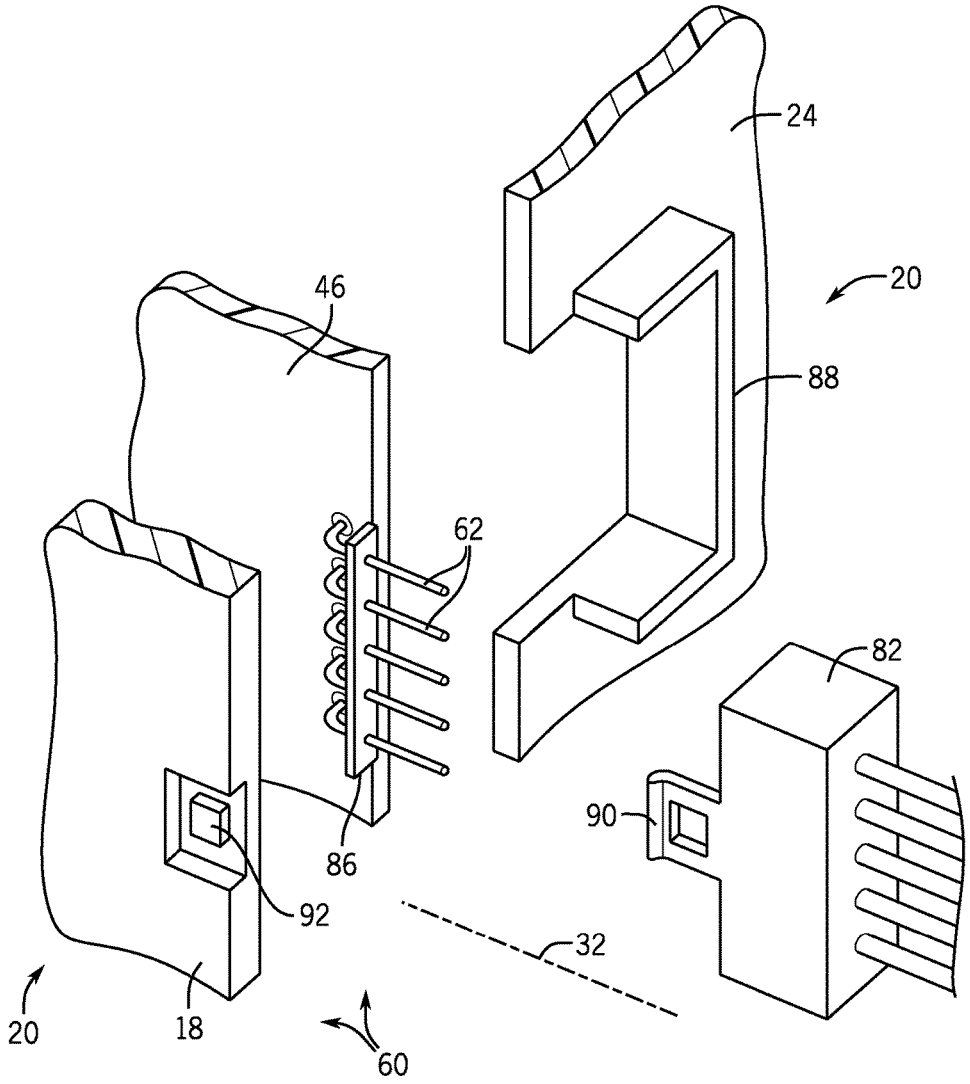
FIG. 5 is an exploded fragmentary view of a housing of the ice-maker motor assembly showing a housing-integrated connector shell having connector pins directly attached to the printed circuit board.

Referring momentarily to FIG. 2, the connector 60 may include a connector shell 84 surrounding the connector pins 62 to provide an assembly that may be attached to the printed circuit board 46. Alternatively, as shown in FIG. 5, the connector pins 62 may be retained in a header 86 for direct attachment to the printed circuit board 46 without a connector shell 84. Instead, an effective connector shell may be provided by means of a tray 88 extending outward along axis 32 from side wall 24 as integrally molded into the side wall 24 of the housing 20 in the vicinity of the pins 62. The tray 88 may provide for bottom and flanking walls to guide corresponding bottom and side walls of the mating connector 82 for receiving a lower half of the connector 82 and guiding it axially along axis 32 into electrical engagement with pins 62. An upper portion of the effective shell for the pins 62 may be provided by the front wall 18.

The mating connector 82 may have a snap tab 90 that may be received by a corresponding tooth 92 formed in the front wall 18. By eliminating the connector shell 84, (shown in FIG. 2) a lower-cost and thinner product may be created.

Encoder Using Hall Effect Sensors

Figure 6:
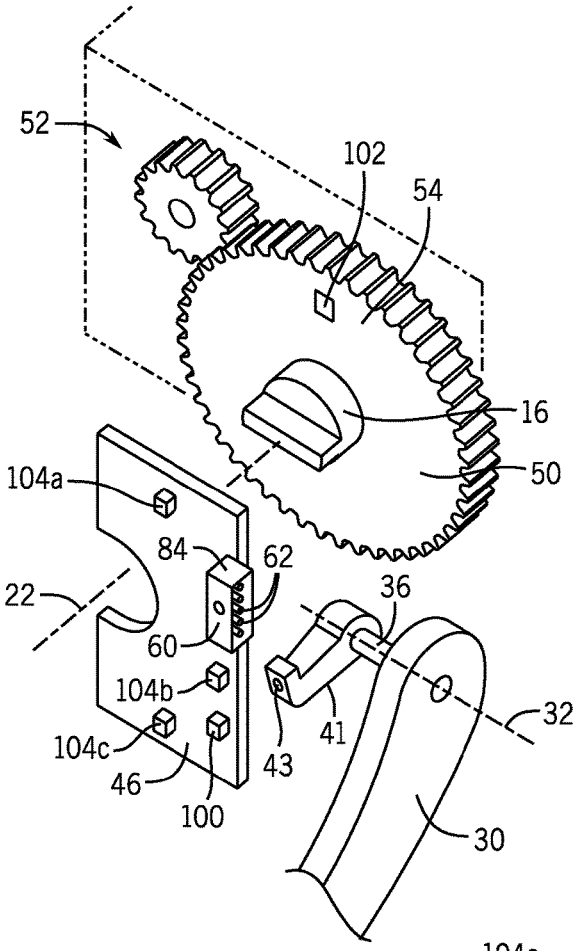
FIG. 6 is a figure similar to that of FIG. 2 in which the encoder-like indication of motor position is provided by Hall effect sensors on the printed circuit board and a magnet on a front face of the drive gear and wherein the position of the bail arm is also indicated by interaction of a magnet on the bail arm and Hall effect sensors on the printed circuit board.

Referring now to FIGS. 1 and 6, the rotatable shaft 36 of the bail arm 30 may alternatively support a radially extending magnet arm 41 having a magnet 43 at its distal end to move past a Hall effect sensor 100 on the printed circuit board 46. The magnet 43 may rotate with the shaft 36 to activate the Hall effect sensor 100 on a printed circuit board 46 when the bail arm 30 has fully descended. When the bail arm 30 cannot fully descend, as obstructed by a filling of the ice storage bin 15 with ice cubes 17, the magnet 43 is stopped away from the Hall effect sensor 100 so that Hall effect sensor 100 is not activated.

A front face 54 of the drive gear 50, generally normal to axis 22, supports a second magnet 102 that may activate respective Hall effect sensors 104*a*-104*c* on the printed circuit board 46 with rotation of the drive gear 50 about axis 22. The Hall effect sensors 104*a*-104*c* are positioned generally at a 12 o'clock position for Hall effect sensor 104*a* directly above axis 22, a three o'clock position for Hall effect sensor 104*b* (as seen from the front) and a six o'clock position for Hall effect sensor 104*c* to allow detection of the position of the drive gear 50 in approximate 90 degree increments.

As before, a cam system (not shown) between the shaft 36 and other elements of the gear train 52 (for example a cam on a reverse face of the drive gear 50) may interact with the bail arm 30 so that rotation of the drive gear 50 raises and drops the bail arm 30 appropriately during operation of the ice-maker 10.

Figure 7:
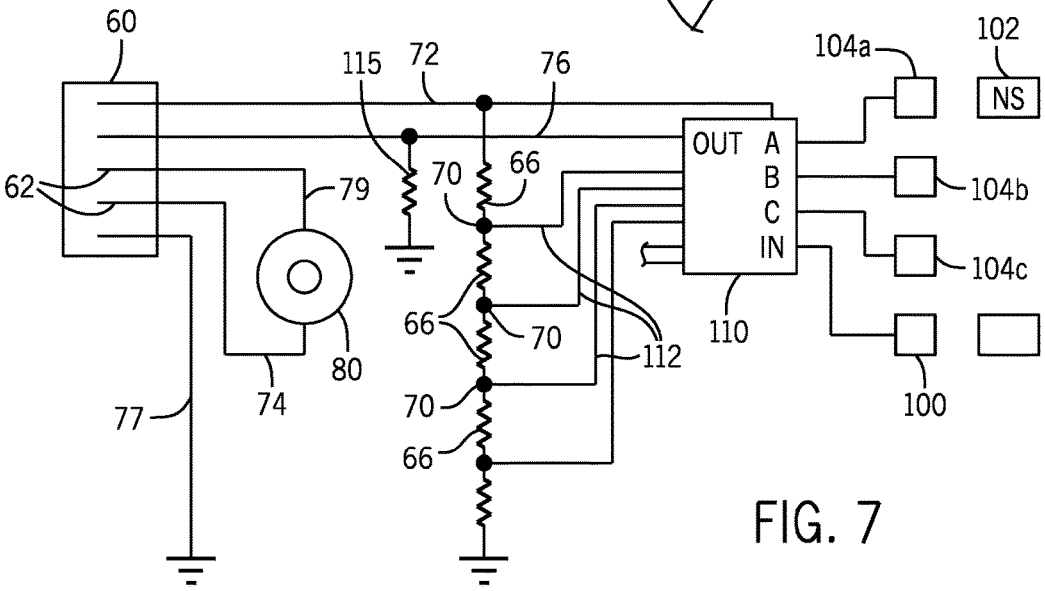
FIG. 7 is a figure similar to that of FIG. 4 showing the electrical schematic of the circuit implemented by the sensor system of FIG. 6.

Referring to FIGS. 2, 6, and 7, the printed circuit board 46 may conduct binary digital signals from each of the Hall effect sensors 104*a*-104*c* to be received, for example, at different digital control inputs of a multiplexer 110, such as a CD4051 multiplexer commercially available from Texas Instruments. The binary signals form a binary word input to the multiplexer 110 to control a connection of output line 76 (similar to that the described above) to one of four different input lines 112 connected to nodes 70 of a resistor ladder formed from resistors 66. In this way, depending on the binary word input to the multiplexer 110, a different nonzero voltage is provided from the resistor ladder to output line 76. A nonzero voltage is provided to output line 76 even when the multiplexer receives a zero input where none of the Hall effect sensors 100 are activated.

The Hall effect sensor 100 associated with the bail arm 30 may be connected to the inhibit line of the multiplexer 110 to disconnect each of the lines 112 from the output line 76 to allow the output line 76 to be pulled to a zero state by a pulldown resistor 115 or the like. In this way the state of each of the sensors 104*a*-104*c* and Hall effect sensor 100 may be mapped to a different voltage value on output line 76.

Dual Drive Mechanism

Figure 8:
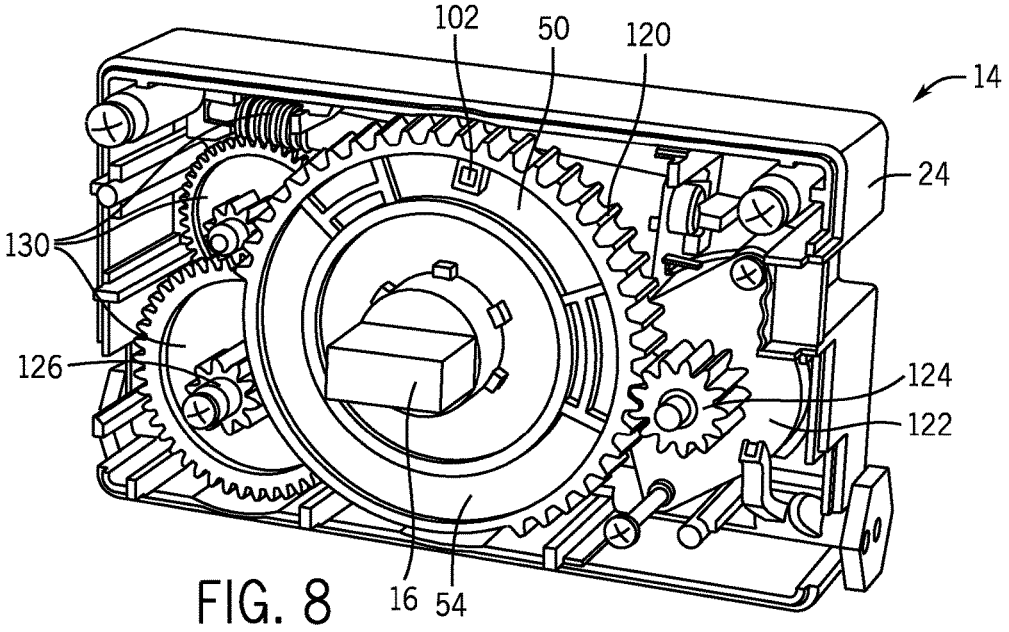
FIG. 8 is a front perspective view of the drive gear of FIG. 6 showing a driving of the drive gear by either of two output gears, the first driven by a brushless motor and the second driven by a brush motor behind the drive gear.
Figure 9:
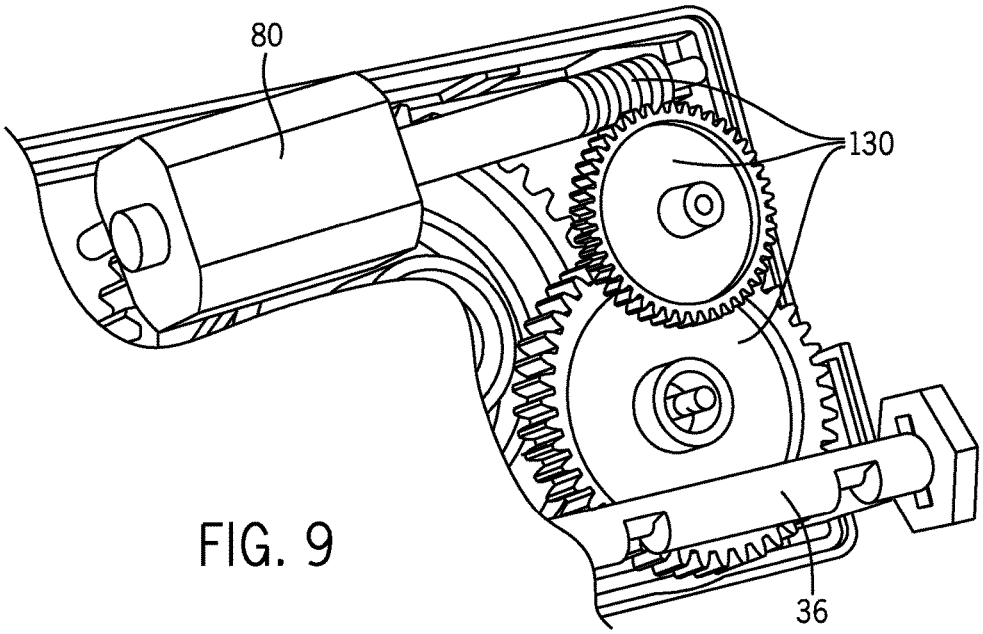
FIG. 9 is a fragmentary rear perspective view of the drive gear of FIG. 8 showing positioning of the brush motor behind the drive gear.

Referring now to FIGS. 8 and 9, in one embodiment of the invention, peripheral teeth 120 of the drive gear 50 may cover only part of the outer circumference of the drive gear 50 to be selectively engaged by a first output gear 124 and/or a second output gear 126. The first output gear 124 is associated with a brushless DC motor 122, such as a stepper motor, while the second output gear 126 is associated with a DC brush motor 80 communicating with this DC brush motor 80 through a gear train 130. Generally the brushless DC motor 122 will provide for lower torque but lower wear during operation (because of the lack of brushes) whereas the gear train 130 and brush motor 80 will provide for higher torque but somewhat greater wear with operation because of the brushes and higher torque associated with the gear train 130.

Figure 10A:
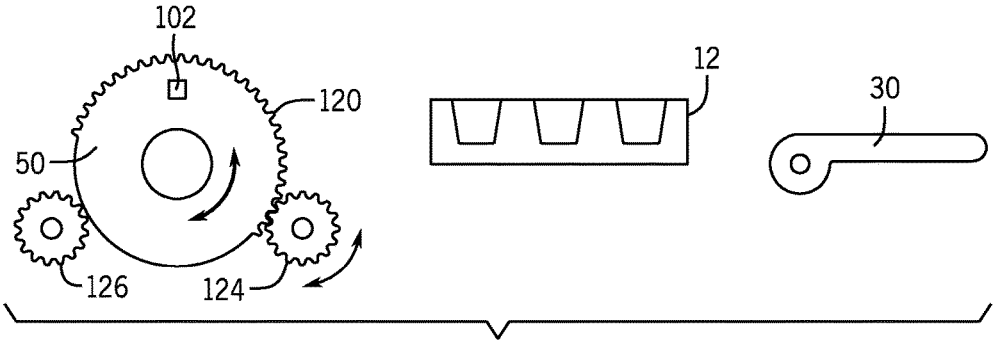
FIGS. 10*a*-10*c* are simplified views of the output gears and drive gear of FIG. 8 showing their operation with various positions of the drive gear and corresponding ice tray and bail arm.
Figure 10B:
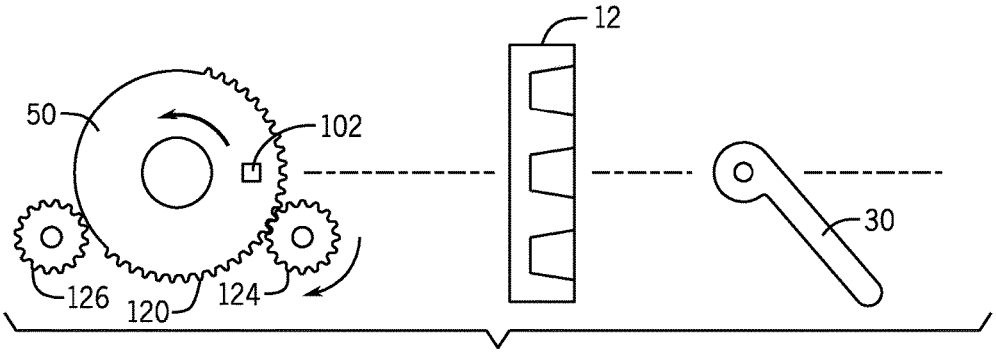
Figure 10C:
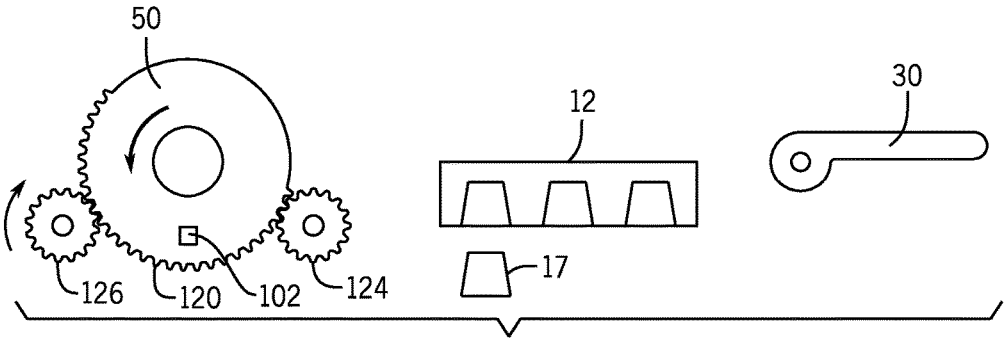

Referring now to FIG. 10, a when the drive gear 50 is in a first position as shown with the magnet 102 sensed by Hall effect sensor 104*a* (shown in FIG. 6) in the 12 o'clock position, the ice mold 12 may be in its upright position suitable for filling with water and the bail arm 30 may be in its raised position. At this time the outer peripheral teeth 120 engage only the output gear 124 which may be operated to reciprocate the drive gear 50 rapidly to agitate water in the mold 12 without spilling it for the purpose of improving ice formation. Output gear 126 at this time will be disconnected from the drive gear 50 because of the lack of teeth 120 at the periphery of the drive gear 50 in the vicinity of output gear 126.

Referring now to FIG. 10*b*, the output gear 124 may then be driven to rotate the drive gear 50 clockwise as shown to move the magnet 102 until it is sensed by Hall effect sensor 104*b* (shown in FIG. 6) in the three o'clock position. The output gear 126 remains at this point disconnected from the drive gear 50 by lack of teeth 120 in its proximity. The ice mold 12 is tipped at this point but is undistorted and does not discharge frozen contained ice cubes and the bail arm 30 is lowered to detect whether there are sufficient ice cubes in the bin 15 (shown in FIG. 1). If there is sufficient ice, as determined by Hall effect sensor 100 (shown in FIG. 6), output gear 124 may be reversed to restore the tray to its horizontal position shown in FIG. 10*a*. Otherwise, output gear 124 further rotates drive gear 50 in the clockwise direction so that teeth 120 engage output gear 126. Now output gear 126 may be activated to assist or replace the torque provided by output gear 124 in rotating the mold 12 to its inverted position for the discharge of ice cubes 17 requiring the high torque associated with the output gear 124.

At the conclusion of discharge of the cubes 17, output gear 124 may return the drive gear 50 to the position of FIG. 10*a*.

Figure 11:
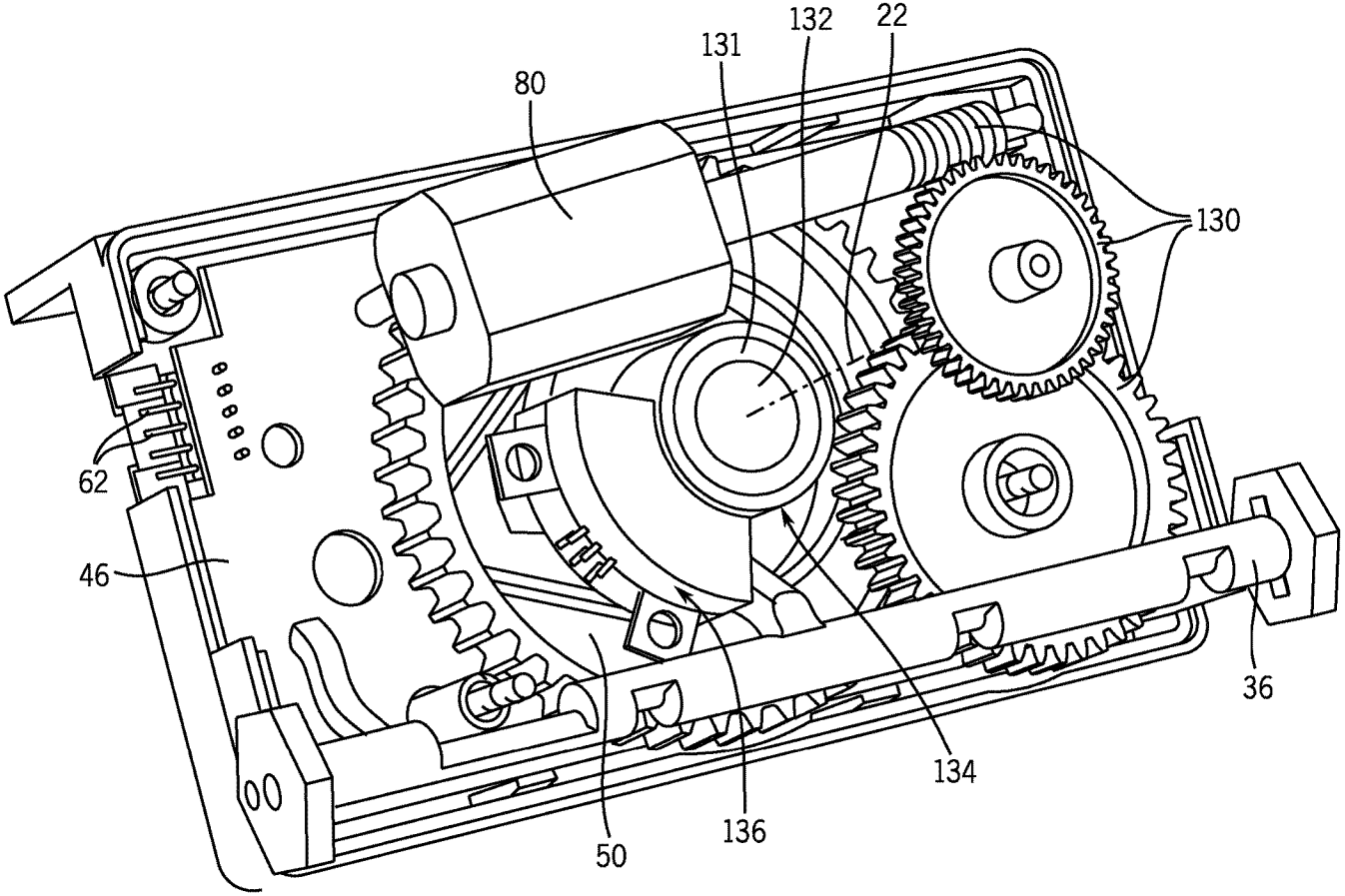
FIG. 11 is a rear perspective view similar to that of FIG. 9 showing a brushless motor integrated into the drive gear which operates as the brushless motor rotor.

Referring now to FIG. 11, in one embodiment, the output gear 124 may be eliminated in favor of a direct drive of an axial shaft 131 of the drive gear 50. The axial shaft 131 may have a tubular central bore 132 extending along axis 22 that may be supported for rotation on a cylindrical post (not shown) also extending along axis 22 and affixed to the housing. The outer cylindrical surface of the axial shaft 131 may have a magnetic material 134 having alternating north and south polarizations as one moves in angle about axis 22. A stator 136 may be positioned adjacent to the magnetic material 134 and include coils causing rotation of the shaft 131 by attraction and repulsion of the periodic magnetic poles of the magnetic material 134 as is understood in the art of stepper motor design. In other respects, the operation of the magnetic material 134 and stator 136 may be to duplicate a brushless DC motor 122 described above.

It will be appreciated that logic circuitry may be provided to selectively activate either the brushless or brush motor depending on the angle of the drive gear 50 and the desired operation of the ice-maker.

Figure 12:
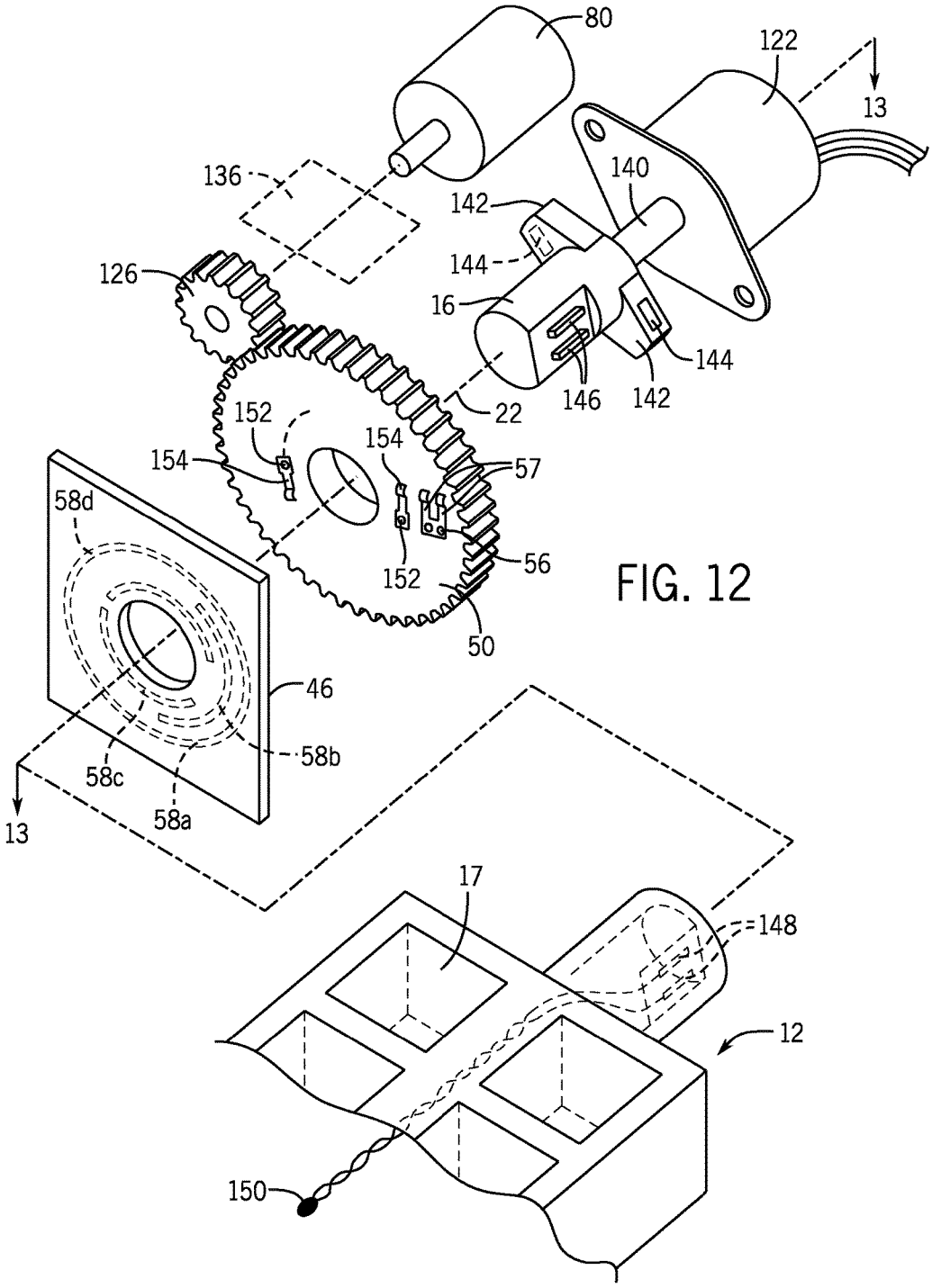
FIG. 12 is an exploded perspective view of a dual drive system similar in purpose to those depicted in FIGS. 8-11 showing a power transmission system for mediating between two motors through the use of interengaging stops and further showing a slip ring system for transmitting temperature sensor information from the ice tray to a stationary circuit card.

Referring now to FIG. 12, in an alternative system for connecting the DC brush motor 80 and brushless DC motor 122 to the ice mold 12, the brushless DC motor 122 may directly drive the drive coupling 16 through a coaxial shaft 140. The drive coupling 16, in this embodiment, may include radially extending arms 142 diametrically opposed across axis 22. Each of the radially extending arms 142 may provide electrical contact surface 144 on one front radially extending face of the radially extending arm 142, the radially extending face being substantially normal to a tangent of rotation of the arms 142.

Each of the electrical contact surfaces 144 may communicate by internal electrical conductors to axially engage electrical connector pins 146 also attached to the drive coupling 16.

The electrical connector pins 146 allow connection to corresponding sockets 148 attached to the ice mold 12 at a point of attachment of the ice mold 12 with the drive coupling 16. These sockets 148 may in turn communicate with a thermistor temperature sensor 150 embedded in the ice mold 12 for sensing the temperature of the ice cubes 17 in the ice mold 12. The electrical connector pins 146 and corresponding sockets 148 provide a releasable electrical connector.

The drive coupling 16 in this embodiment extends through a central hole in the gear 50, the latter of which serves as a secondary drive element that may be driven by gear 126 through gear train 130 by brush motor 80. As before, gear 50 may include wiper assembly 56 with joined flexible wiper fingers 57 communicating with arcuate traces 58*a* and 58*b* on printed circuit board 46 to provide a position encoding function as described above.

Referring also to FIG. 13, drive gear 50 may provide two diametrically opposed wiper fingers 154 on the same surfaces as wiper fingers 154 for engaging arcuate slip rings 58*c* and 58*d* on the printed circuit board 46. The slip rings 58*c* and 58*d*, like arcuate traces 58*a* and 58*b*, communicate with the connector pins 62 discussed above.

Each of the wiper fingers 154 extends through openings 152 in the gear 50 to pass outward below the gear 50 as contact fingers 160. When the arms 142 rotate beyond a predetermined range with respect to the gear 50, a stop 162 on the inner surface of the gear 50 contacts the arms 142 to cause the gear 50 to move with the drive coupling 16. At that time, the contact fingers 160 electrically connect to the electrical contact surfaces 144 on the arms 142 providing an electrical path from the thermistor 150 through connector pins 146, through the electrical contact surface 144, through contact fingers 160, and through wiper fingers 154 to slip ring 58*c* or 58*d*, respectively.

Referring now to FIG. 14*a*, during large angle rotation of the ice mold 12 of 360 degrees of rotation, the ice mold 12 is rotated by the drive coupling 16 as driven by rotation of the gear 50 (for example, counterclockwise rotation as depicted) which in turn is driven by the brush motor 80. This rotation brings stop 162 into contact with the arms 142 of the drive coupling 16 so that the gear 50 and the drive coupling 16 rotate in tandem. Such large angle rotation, for example, may move the ice mold 12 from an inverted ice ejection position back into its upright position for filling and refreezing of the water in the ice mold 12. During this large angle rotation, contact fingers 160 electrically connect to surfaces 144 allowing measurement of the temperature of thermistor 150 to be obtained by a remote device communicating through connector pins 62. During this large angle rotation, the brushless motor ice mold 12 is deactivated and rotates passively.

Referring now to FIG. 14, when the ice tray is in the upright and filled position, the drive coupling 16 may be directly driven by the stepper motor ice mold 12 with the brush motor 80 deactivated. First, arms 142 are moved clockwise away from the stop 162 and then back toward the stop 162 in a rapid reciprocating motion controlled by a counting of a number of step signals provided to the stepper motor ice mold 12. By decoupling the wiper fingers 154 from the drive coupling 16 during this rapid reciprocation, excessive wear of the slip rings 58*c* and 58*d* is avoided.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What is claimed is:

1. An ice making apparatus comprising:

a housing having a front wall positioned adjacent to an ice mold, wherein the ice mold is for molding ice cubes;

a rotatable shaft that extends through the front wall and is rotatable about an axis, the rotatable shaft having a first end within the housing and a second end displaced from the first end along the axis and said second end is configured to be attached to the ice mold;

a position sensor configured to communicate with the rotatable shaft to provide an electrical position signal indicating a position of the rotatable shaft; and electrical conductor attached to the position sensor and configured to communicate the electrical position signal to an electrical controller for controlling ice making;

wherein the ice making apparatus further includes:

a brushless motor positioned within the housing and is configured to drive the first end of the rotatable shaft to rotate the rotatable shaft in a first mode of operation for agitating freezing water; and a brush motor positioned within the housing and is configured to drive the first end of the rotatable shaft to rotate the rotatable shaft in a second mode of operation for releasing ice.

2. The ice making apparatus of claim 1 wherein the brush motor is further configured to receive electrical signals from the controller;

whereby the electrical controller is further configured to control the brush motor according to the electrical position signal.

3. The ice making apparatus of claim 1 wherein the electrical position signal has a magnitude indicating the position of the rotatable shaft.

4. The ice making apparatus of claim 3 wherein the position sensor provides a set of electrically switched connections communicating with a resistor ladder to provide a voltage dependent on a state of the electrically switched connections as they change with a rotation of the position sensor and wherein the voltage is the electrical position signal.

5. The ice making apparatus of claim 4 wherein the position sensor includes a printed circuit board positioned to extend perpendicularly to the rotatable shaft providing traces having arcuate surfaces concentric about an axis of rotation of the rotatable shaft that may be selectively interconnected by a wiper rotating with the rotatable shaft to implement the set of electrically switched connections.

6. The ice making apparatus of claim 4 wherein the position sensor includes a magnet element and a magnet supporting structure with the magnet element attached to the magnet supporting structure and the magnet supporting structure attached for rotation with the rotatable shaft, and further includes multiple angularly displaced Hall effect sensors positioned along a path of the magnet element with rotation of the rotatable shaft to provide electrically switched connections that vary with rotation of the magnet element to provide the electrical position signal.

7. The ice making apparatus of claim 1 wherein the ice mold is attached to the rotatable shaft for rotating therewith, the ice mold including cavities for receiving and holding water in an upright position for freezing the water.

8. The ice making apparatus of claim 1 further including a printed circuit board within the housing that extends perpendicularly to the axis of the rotatable shaft, the printed circuit board supporting at least a portion of the position sensor;

wherein the electrical conductors provide connector pins of a releasable electrical connector, the connector pins attached to the printed circuit board extend through the housing to provide electrical communication to the printed circuit board; and wherein the housing provides an integrated connector shell for surrounding the connector pins to guide and retain a corresponding mating electrical connector.

9. The ice making apparatus of claim 8 wherein the housing has interfitting front and back portions each supporting part of the integrated connector shell and together providing a shroud surrounding the connector pins.

10. The ice making apparatus of claim 1 wherein the housing further includes right and left sidewalls flanking the front wall and further includes a second rotatable shaft extending from at least one of the right and left side walls to provide an exposed end of the second rotatable shaft outside of the housing;

a reciprocating mechanism communicating with the rotatable shaft to provide reciprocation of the second rotatable shaft with rotation of the rotatable shaft; and a bail arm attachable to the exposed end.

11. The ice making apparatus of claim 10 further including a second position sensor configured to communicate with the second rotatable shaft to sense a position of the bail arm.

12. The ice making apparatus of claim 11 further including a printed circuit board extending perpendicularly to the rotatable shaft and wherein the second position sensor is an electrical switch having contacts formed on the printed circuit board contacting contacts movable with the second rotatable shaft.

13. The ice making apparatus of claim 11 wherein the second position sensor is a magnet sensor configured to be activated by a magnet, and wherein the magnet is mounted to move with the second rotatable shaft.

14. The ice making apparatus of claim 1 wherein the brushless motor is a stepper motor.

15. The ice making apparatus of claim 1 including a power transmitting mechanism physically engaging the brushless motor only over a first range of rotation of the rotatable shaft and physically engaging the brush motor only over a second range of rotation of the rotatable shaft different from the first range.

16. The ice making apparatus of claim 15 wherein the first and second range of rotation overlap.

17. The ice making apparatus of claim 15 wherein the power transmitting mechanism is a gear having an outer periphery following a radius about an axis of rotation of the gear and having teeth along only a portion of the periphery to selectively engage a first gear driven by the brush motor in the first range of rotation and a second gear driven by the brushless motor in the second range of rotation.

18. The ice making apparatus of claim 15 wherein the power transmitting mechanism is a stop surface attached to a rotatable drive element driven by the brush motor, the stop surface engaging a concentrically rotating arm attached to the rotatable shaft driven by the brushless motor, the stop surface being configured to engage the rotating arm when the rotatable arm passes beyond a predetermined angular position with respect to rotatable drive element;

whereby the rotating arm is configured to reciprocate within a predetermined angular range without engagement with the rotatable drive element.

19. The ice making apparatus of claim 18 further including temperature sensor signal conductors, wherein the temperature signal conductors are attached to the rotatable shaft and thereby rotate with the rotatable shaft and are configured for communication with a temperature sensor in the ice mold attached to the rotatable shaft, wherein the ice making apparatus further including a slip ring system attached between the rotatable drive element and circuitry fixed with respect to the housing; and the ice making apparatus further including contacts for connecting the signal conductors on the rotatable shaft with a portion of the slip ring system on the rotatable drive element only when the rotating arm engages the rotatable drive element.

20. The ice making apparatus of claim 1 further including a speed reduction gear train between the brush motor and the rotatable shaft.

21. The ice making apparatus of claim 1 wherein the controller is configured to communicate with the brushless motor to alternate directions of the brushless motor to provide a controlled amplitude of agitation.

22. The ice making apparatus of claim 1 wherein the brush motor is configured to be disconnected from the rotatable shaft when the brushless motor is connected to the rotatable shaft and the brush motor is configured to be connected to the rotatable shaft when the brushless motor is disconnected from the rotatable shaft.

23. The ice making apparatus of claim 1 wherein the bush motor is configured to engage with the first end of the rotatable shaft only during the second mode of operation for releasing ice to reduce wear on the bush motor.

24. The ice making apparatus of claim 1 wherein the brush motor is configured to engage with the first end of the rotatable shaft through a speed reduction gear train only during the second mode of operation to permit motion of the shaft motion of the shaft by the brushless motor during the first mode of operation.

* * * * *